United States Patent [19]

Cunningham

[11] 4,217,199

[45] Aug. 12, 1980

[54] ELECTROLYTIC CELL

[75] Inventor: Hugh Cunningham, Corpus Christi, Tex.

[73] Assignee: PPG Industries, Inc., Pittsburgh, Pa.

[21] Appl. No.: 56,152

[22] Filed: Jul. 10, 1979

[51] Int. Cl.[2] ..... C25B 1/16; C25B 1/26; C25B 9/02

[52] U.S. Cl. ..... 204/256; 204/255; 204/286; 204/288

[58] Field of Search ..... 204/252, 253, 255, 256, 204/257, 258, 266, 286, 288

[56] References Cited

U.S. PATENT DOCUMENTS

| | | | |
|---|---|---|---|
| 1,535,185 | 4/1925 | Spencer | 204/256 |
| 3,222,270 | 12/1965 | Edwards | 204/266 X |
| 3,242,065 | 3/1966 | DeNora et al. | 204/256 |
| 3,697,404 | 10/1972 | Paige | 204/288 X |
| 3,857,774 | 12/1974 | Morton et al. | 204/288 X |
| 3,859,196 | 1/1975 | Ruthel et al. | 204/266 X |
| 4,107,023 | 8/1978 | Mentz | 204/286 X |

*Primary Examiner*—Arthur C. Prescott
*Attorney, Agent, or Firm*—Richard M. Goldman

[57] ABSTRACT

Disclosed is an electrolytic cell having a plurality of hollow anode elements electrically in parallel with each other and a plurality of hollow cathode elements electrically in parallel with each other. Each of the anode elements are interposed between a pair of cathode elements and separated therefrom by a planar, ion permeable separator sheet, and each of the cathode elements are interposed between a pair of anode elements and separated therefrom by a planar, ion permeable separator sheet. The electrode elements are held in compression to provide an electrolyte tight electrolytic cell.

30 Claims, 11 Drawing Figures

ELECTROLYTIC CELL

DESCRIPTION OF THE INVENTION

In the commercial manufacture of chlorine and alkali metal hydroxides, an electrolytic cell is utilized having an anolyte compartment separated from a catholyte compartment by an ion permeable separator. The anolyte compartment has acidic anolyte containing from about 125 to about 250 grams per liter of sodium chloride or from about 160 to about 320 grams per liter of potassium chloride, at a pH of from about 2.5 to about 5.5, with chlorine being evolved at the anode. The catholyte compartment has an alkaline catholyte containing more than one mole per liter of alkali metal hydroxide, with hydrogen being evolved at the cathode.

The separator separates the acidic anolyte from the alkaline catholyte, thereby avoiding the formation of alkali metal chlorates. The separator may be a synthetic separator such as a microporous diaphragm or a permionic membrane. Alternatively, the separator may be an asbestos diaphragm.

Microporous diaphragms, i.e., as microporous fluorocarbon films, and asbestos diaphragms, including resin reinforced asbestos diaphragms, allow chloride ion to difuse through the separator, providing a cell liquor of alkali metal hydroxide and alkali metal chloride, e.g., about 10 to 15 weight percent alkali metal hydroxide, and about 15 to 25 weight percent alkali metal chloride.

Alternatively, the separator may be a synthetic permionic membrane, i.e., a cation selective permionic membrane. Cation selective permionic membranes useful in chloralkali electrolysis include fluorocarbon resins with pendent cation selective, anion blocking groups thereon such as carboxylic acid groups, sulfonic acid groups, phosphonic acid groups, phosphoric acid groups, derivatives thereof, such as reaction products with amides, amines, alcohols and the like, and precursors thereof.

The prior art teaches the use of asbestos diaphragms deposited on an electrolyte permeable cathode, especially a cathode having rounded edges and a complex shape. However, the use of synthetic separators such as the fluorocarbon materials described above, and the fluorocarbon resin reinforced asbestos materials as also described above, is now preferred. Fluorocarbon materials useful in forming synthetic separators are difficult to form into the shapes necessary for banks of fingered electrodes. Similarily, resin reinforced asbestos diaphragms, while easier to shape into the forms necessary for banks of fingered electrodes, may be of more uniform properties if preformed prior to installation. The provision of joints, seams, and convolutions requires high temperatures, strong reagents, solvents, and the like, all of which may have a deleterious effect on the electrodes. An electrolytic cell design that eliminates such joints, seams and seals while retaining high capacity is particularly preferred.

A particularly satisfactory electrolytic cell design, intended for use with synthetic separators and resin reinforced asbestos diaphragms, should be one providing an electrolyte tight seal while avoiding complex post-assembly seaming, sealing, and joining. It has now been found that one particularly satisfactory design, providing the high electrode area advantages of fingered electrodes, the ease of assembly of pancake cell designs, and the substantial avoidance of seams, seals and joints in the membrane, is one where the electrode units are in the form of peripheral rectangular compartment frames open on two major opposite surfaces, with a planar metal electrode on each of the two opposing open major surfaces, and means for electrolyte feed, electrolyte recovery, gas recovery an intra-electrolyte circulation in each electrode unit. The electrolytic cell is a plurality of such electrode units, both anode and cathode units, interleaved between each other, and electrically in parallel with other elements of the same polarity, as in a fingered cell.

FIGURES

DETAILED DESCRIPTION OF THE INVENTION

Figures 1, 5:
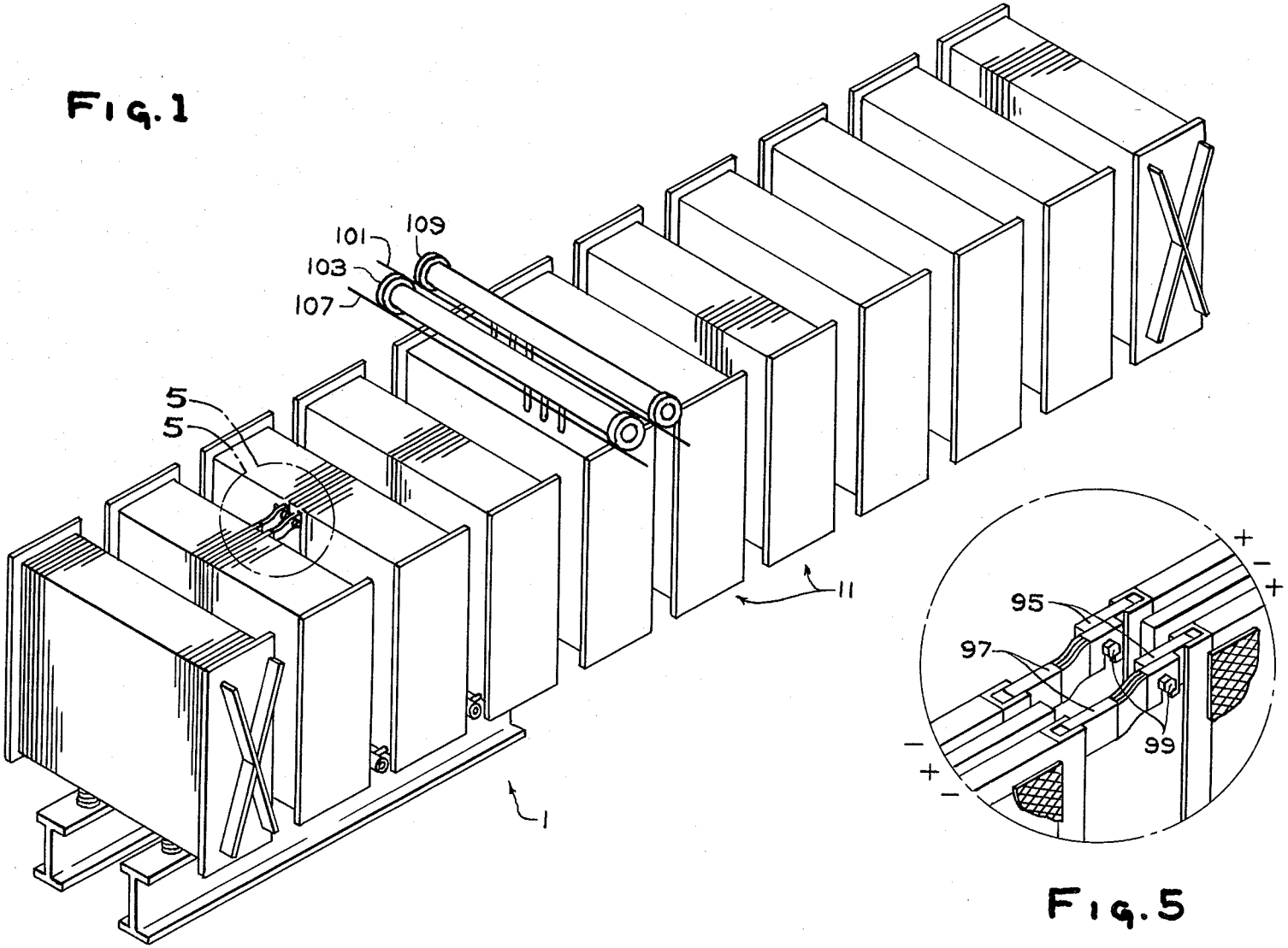
FIG. 1 is an isometric view of an electrolyzer of this invention.
FIG. 5 is an isometric view of the current connecting means of the electrolyzer utilizing the electrolytic cells of this invention.
Figure 2:
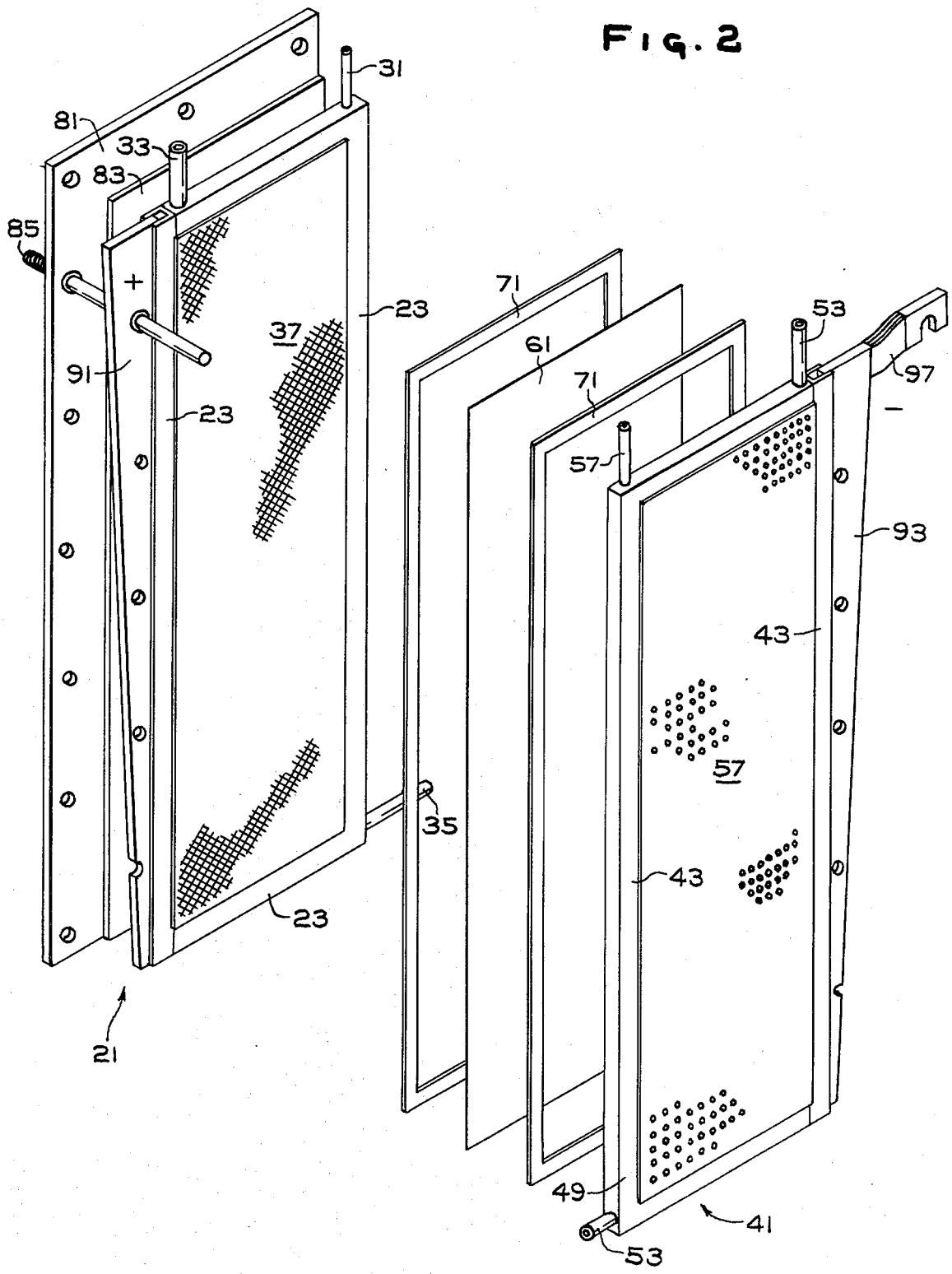
FIG. 2 is an exploded isometric view of an anode element, a cathode element, an associated gasketing and separator.
Figure 4:
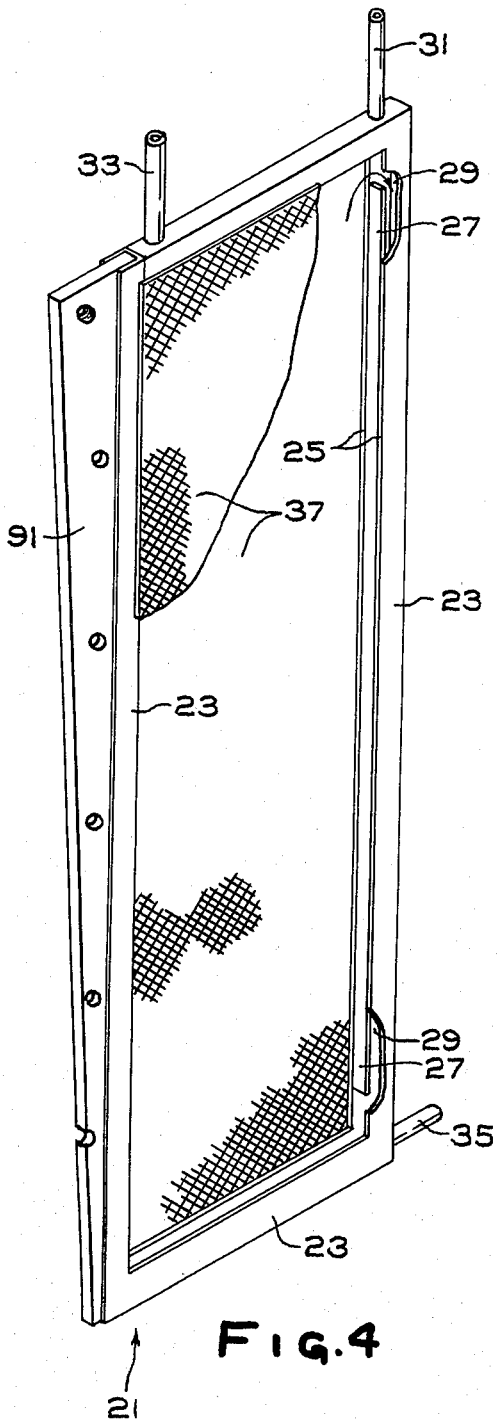
FIG. 4 is a partial cutaway isometric view of an anode unit of the electrolytic cell of this invention.
Figure 3:
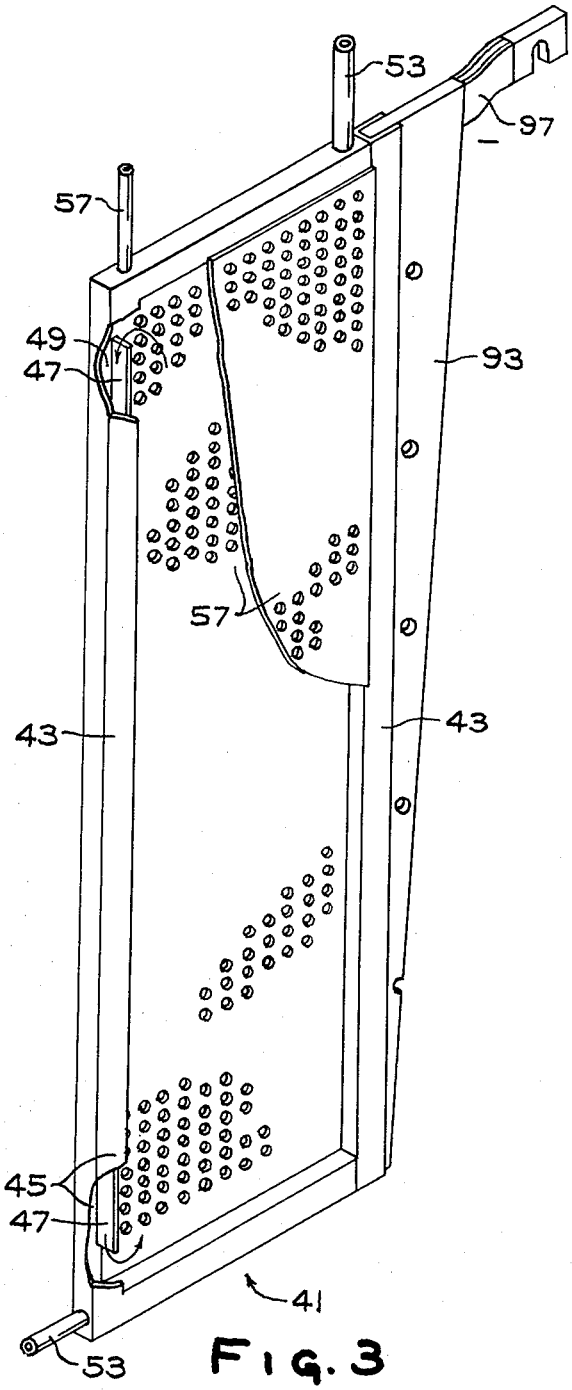
FIG. 3 is a partial cutaway isometric view of the cathode unit of the electrolytic cell of this invention.
Figure 6:
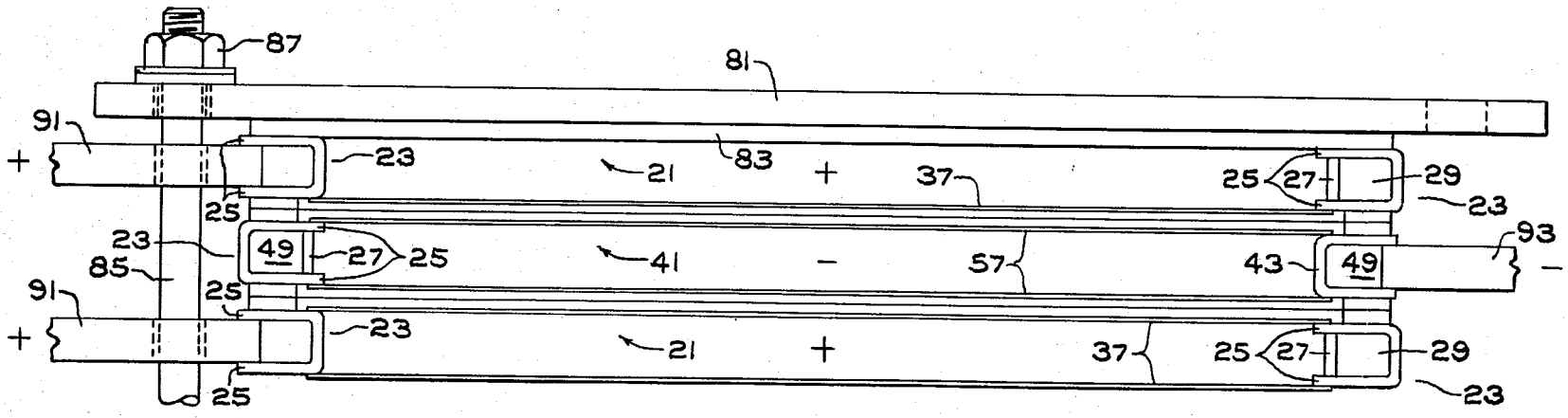
FIG. 6 is a cutaway plan view of the electrolytic cell of this invention.
Figure 10:
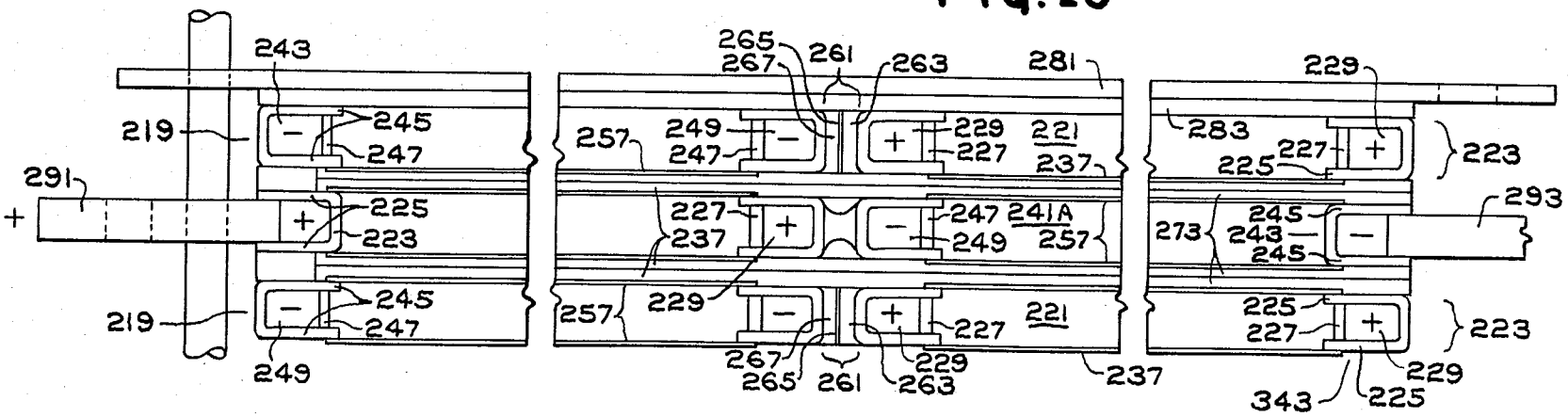
FIG. 10 is a cutaway top view of the alternative exemplification of this invention utilizing bipolar elements.
Figure 7:
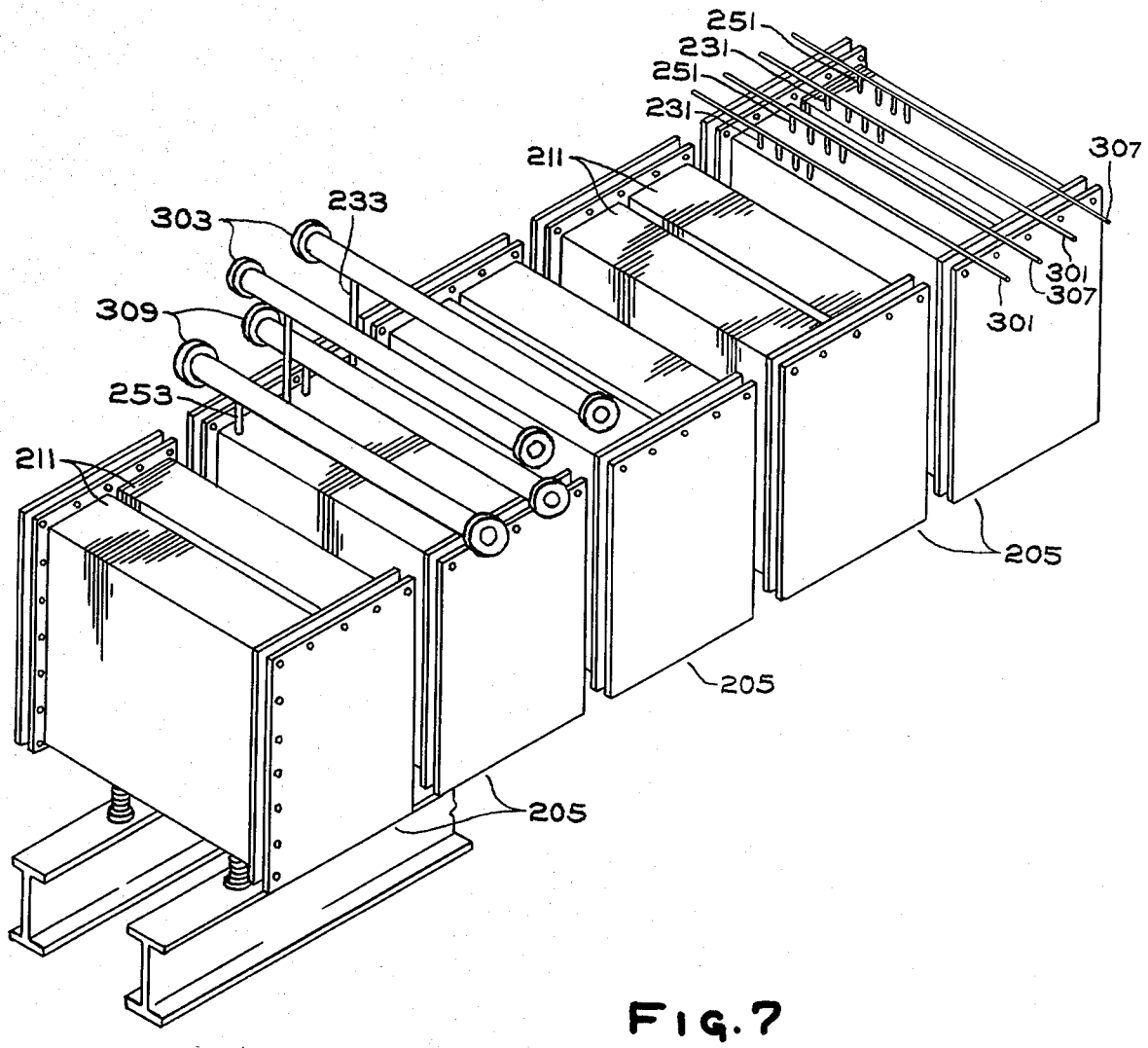
FIG. 7 is an isometric view of an alternative exemplification of this invention utilizing bipolar elements.
Figure 8:
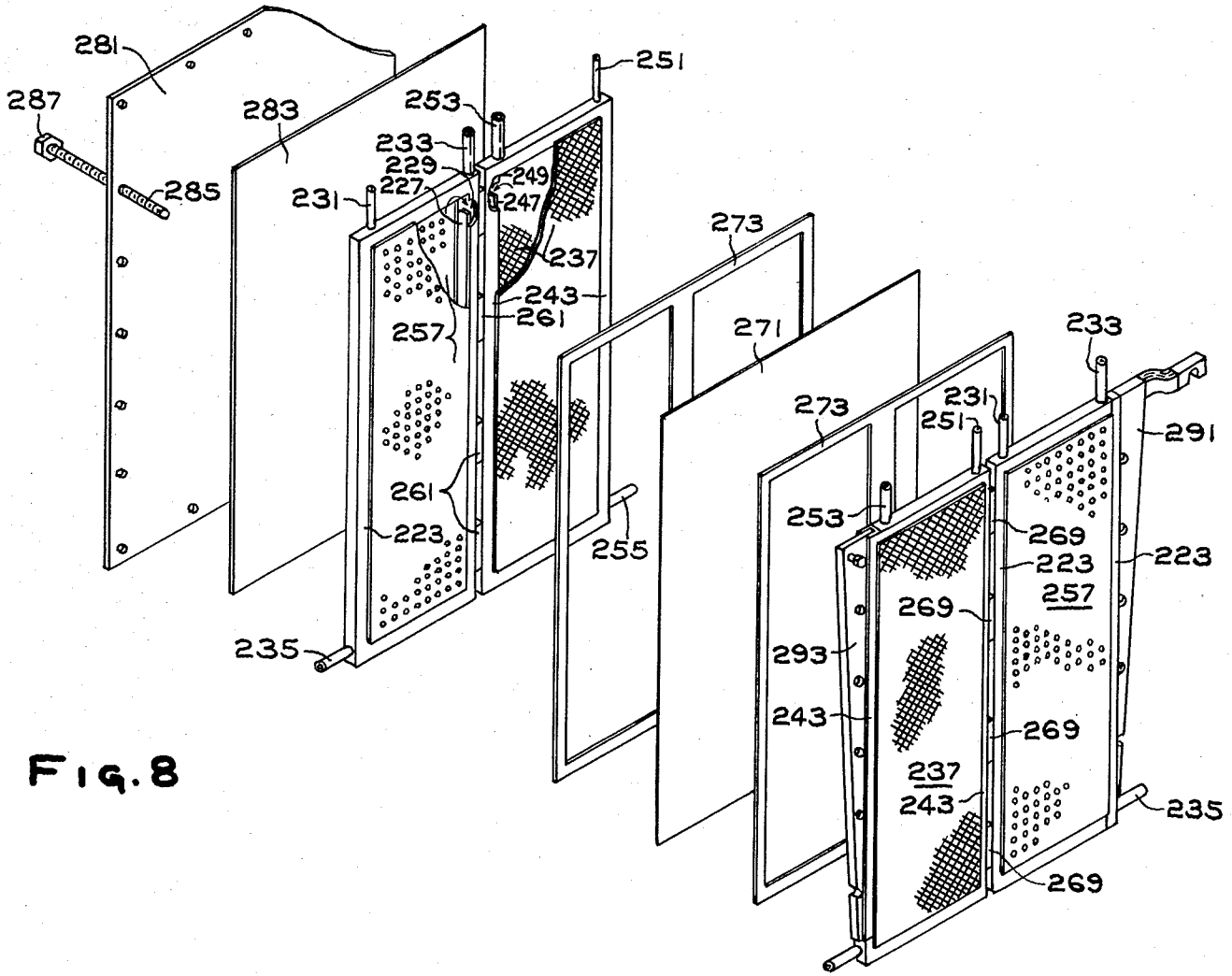
FIG. 8 is an exploded isometric view of the exemplification of this invention using bipolar elements.
Figure 11:
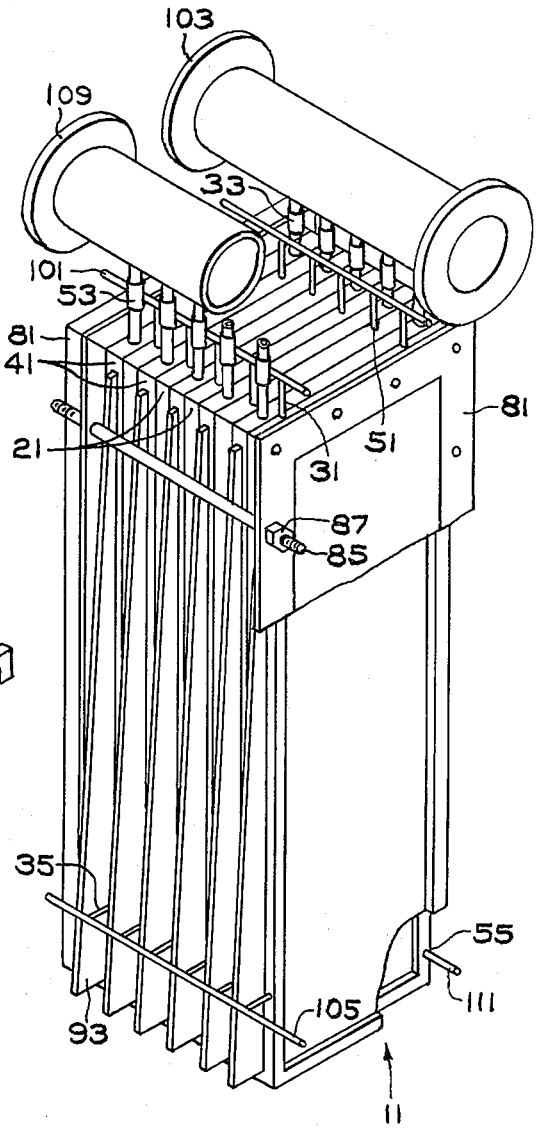
FIG. 11 is a partial cutaway isometric view of alternative exemplification of this invention as assembled.
Figure 9:
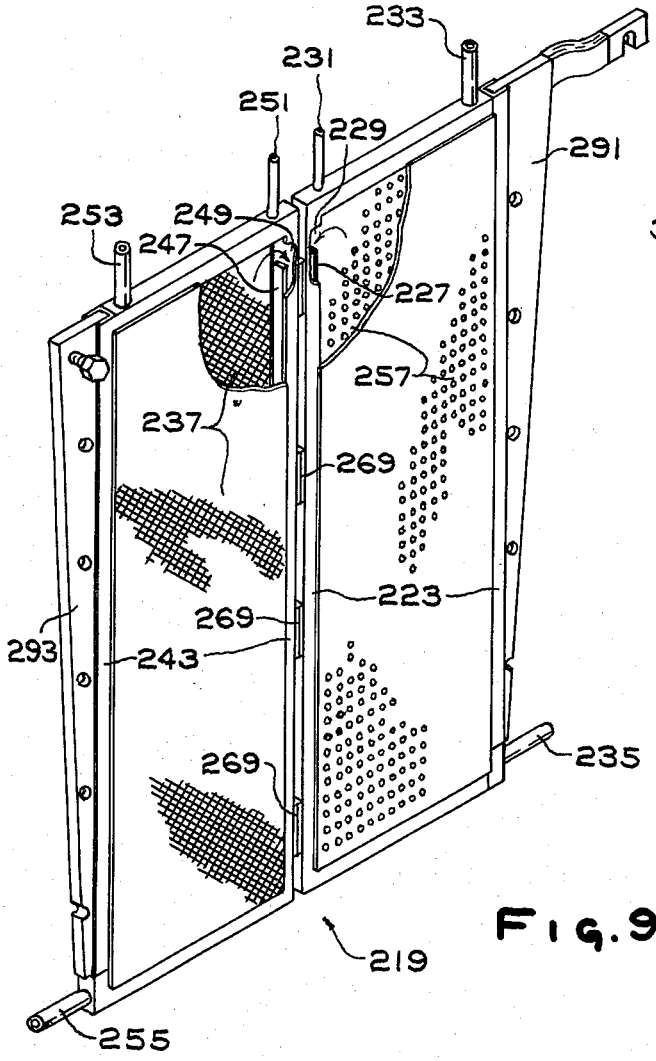
FIG. 9 is a partial cutaway isometric view of an element having an anodic subunit and a cathodic subunit as utilized in the bipolar embodiment.

The electrolytic cell herein contemplated is characterized by the provision of substantially planar, nonconvoluted, nonseamed, nonjoined, nonwelded separators between the anode compartments and cathode compartments of the individual electrolytic cells.

The cell structure, generally, of an exemplification of this invention utilizing monopolar electrodes is shown in FIGS. 1–6. As there shown, the electrolytic cell series 1, includes individual electrolytic cells 11. An individual electrolytic cell 11 has individual anode elements 21 electrically in parallel, and individual cathode elements 41 electrically in parallel. An individual anode element 21 is interposed between a pair of adjacent cathode elements 41, and an individual cathode element 41 is interposed between a pair of adjacent anode elements 21. An ion permeable separator sheet 61 i.e., an asbestos diaphragm, a resin reinforced asbestos diaphragm, a cation selective permionic membrane or a synthetic microporous diaphragm, is interposed between each anode element 21 and the adjacent cathode element 41 as a planar, single sheet without folds, seams, welds, or convolutions.

The brine circuit includes the brine feed header 101 which feeds the individual anodic elements 21 through brine lines 31. Chlorine is recovered from the individual anode elements 21 through chlorine line 33 to chlorine header 103 while depleted brine is recovered from the individual anode elements 21 through brine line 35 to depleted brine header 105. In a particularly preferred exemplification, brine feed line 31 feeds brine to an internal downcomer 29, whereby brine is introduced near the bottom of the anode unit 21, and receives a lifting effect between the anodes 37.

The water-hydroxyl circuit includes water header 107 which feeds water to individual water lines 51 for each individual cathodic element 41. Hydrogen is recovered from such individual cathodic element 41 through hydrogen line 53 to hydrogen header 109 while catholyte cell liquor is recovered from individual cathode elements 41 through hydroxyl line 55 to hydroxyl header 111. In a particularly preferred exemplification water feed is to an internal downcomer 49, whereby the water is effectively introduced near the bottom of the catholyte compartment, and receives a lifting effect between the cathodes, 57.

The electrical conductivity is from anode bus bar 91 through the anodic elements 21 to the cathodic elements 41 thence out through the cathodic bus bars 93.

An alternative exemplification of the electrolytic cell herein contemplated is shown in FIGS. 7–10. As there shown, a series of electrolytic cells 201 includes a plurality of two cell electrolyzers 205 each having an individual cell 211. The two cell electrolyzer 205 includes bipolar units 219, which are parallel to each other and have an anodic half cell, i.e., an anodic subunit 221 and a cathodic half cell, i.e., a cathodic subunit 241. Interposed between each bipolar electrode unit 219 are monopolar half cells, i.e., monopolar units 221A and 241A. The monopolar units 221A and 241A are arrayed end-to-end and electrically insulated from each other. The anodic monopolar units 221A are parallel to, facing, and spaced from the cathodic half cells, i.e., the cathodic subunits 241 of the bipolar units 219. The cathodic monopolar units 241A are parallel to, face, and spaced from the anodic half cells, i.e., the anodic subunits 221 of the adjacent bipolar units 219. Anodic units 221 are separated from the facing cathodic units 241A by ion permeable separator sheets 271 and the anodic subunits 221A are separated from the facing individual cathodic units 241 by the ion permeable separator sheets 271.

The brine-chlorine circuit for the bipolar embodiment includes brine header 301 which feeds the individual brine lines 231. Chlorine is recovered from the individual anodic elements 221, 221A through individual chlorine lines 233 to chlorine header 303 while depleted brine is recovered from the individual anodic elements 221 and 221A through depleted brine lines 235 to depleted brine header 305.

The water-hydroxyl circuit feeds the individual cathodic elements 241, 241A through water header 307 to water lines 251. Hydrogen is recovered from the individual cathodic elements 241, 241A through individual hydrogen lines 253 to the hydrogen header 309. Catholyte cell liquor, that is, either the hydroxide solution or the hydroxide-chloride solution, is recovered from the individual cathodic elements 241, 241A through individual lines 255 to the hydroxyl line header 311.

The electrical circuit of the bipolar design is through anode bus bars 291 to the anodic monopolar unit 221A, through the bipolar unit 219, and then through the cathodic monopolar unit 241A to the cathode bus bars 293. The specific circuit is from the anode bus bars 291 to the anodic monopolar unit 221A, thence to the cathodic bipolar unit 241 through the bipolar element 261 to the anodic element 221 and then to the cathodic monopolar element 241A and out through the cathode bus bars 293.

Turning now to the individual cell components, the monopolar electrolytic cell series 1, includes the individual electrolytic cells 11, shown in FIG. 1. The individual cells 11 include individual anode elements 21 that are electrically in parallel with each other, and individual cathode elements 41 that are electrically in parallel with each other. The individual anode elements 21 are interposed between the individual cathode elements 41 and the individual cathode elements 41 are interposed between individual anode elements 21 with an ion permeable separator sheet 61 between an anode 21 and an adjacent cathode 41. The ion permeable separator sheet 61 is a planar sheet, characterized by the substantial absence of folds, seams, welds or convolutions.

The individual anode unit 21 includes peripheral rectangular compartment frame 23. The frame 23, in the form of a picture frame, is open on the two major opposite surfaces, whereby to support the anodic electrode 37. The frame 23 includes a pair of vertical channel frames 25 which may, in a preferred exemplification, be "U" shaped. At least one of the vertical channel frames 25 is concave with respect to the interior of the frame 23. In a further preferred exemplification the concave channel frame 25 includes plate means 27 spaced from the edge of the vertical channel frame 25 and parallel thereto, whereby to provide a downcomer 29. The peripheral rectangular compartment frame 23 further includes a pair of horizontal channel frames 25 which may, be "U" shaped as described above and may be either both concave or both convex or convex and concave with respect to the interior of the compartment frame 23. The compartment frame elements 25 are typically fabricated of a valve metal such as titanium, titanium alloys, tantalum, tungstum, colombium or the like, or a laminate of a valve metal surface in contact with anolyte liquor and iron, steel or the like as the outer surface.

The anode 37 is supported by the channel frame 23, and is an electrolyte permeable plane, for example, mesh, perforated plate, sheet, rods or the like. Where rods are used, preferably they are vertical rods. The anode 37 is valve metal substrate having a catalytically active coating thereon. Valve metals are those metals which form an oxide upon exposure to acidic media under anodic conditions as described hereinabove. The coating is a material which provides a low chlorine evolution overvoltage.

Associated with the anode units 21 are a brine feed line 31, chlorine recovery line 33, depleted brine removal line 35 and a bus bar 91.

The cathode units 41 include a peripheral rectangular compartment frame 43 open on two major opposite surfaces to support the cathodic electrode 57. The peripheral rectangular compartment frame includes a pair of vertical channel frames 45 which may be U shaped. In a preferred embodiment, one vertical channel frame 45 is concave with respect to the interior of compartment frame 43 and has plate means 47 therein defining a downcomer 49. The plate means 47 is parallel to and spaced from the channel frame 45. The other vertical channel frame 45 may be convex or concave with respect to the interior frame. However, the other vertical channel frame should be adapted to carry cathodic bus bar means 93.

The peripheral rectangular compartment frame 43 further includes a pair of horizontal channel frames 45 which may be U shaped. Both of the horizontal channel frames 45 may be concave with respect to the interior of the channel frame 43 or convex with respect to the interior of the channel frame 43 or one may be concave and one may be convex. The four channel frames define a rectangular compartment frame 43 in the shape of a picture frame.

The channel frames 45 are preferably fabricated of a material which is catholyte resistant.

The planar metal cathode 57, may be sheet, perforated sheet, perforated plate, expanded metal mesh, rods or the like. Where rods are used, preferably they are vertical. The cathode 57, is supported by the compartment frame 43 and is fabricated of a catholyte resistant material. The cathodic element 57 is electrolyte permeable, that is, electrolyte can easily pass through it. It may have a catalytic coating thereon, for example, a coating which reduces the hydrogen evolution overvoltage.

The cathodic unit 41, including the peripheral rectangular compartment frame 43, further includes water feed line 51, hydrogen recovery line 53, cell liquor recovery line 55 and bus bar 93.

Gasket means 71 are interposed between each pair of electrode units 21, 41 such that there is a gasket 71 between an anode unit 21 and the facing adjacent cathode unit 41. According to one exemplification, two gaskets 71 may be interposed between an anode unit 21 and a cathode unit 41 with the permionic membrane 61 being interposed between the pair of gaskets. According to an alternative exemplification where the permionic membrane bears upon the anode 21, the gasket means 71 may be interposed between the permionic membrane 61 and the cathode 41. According to an alternative exemplification where the permionic membrane 61 bears upon the cathode 41, the gasket means may be interposed between the permionic membrane 61 and the anode 21.

Preferably, the gasket means is fabricated of a resilient, electrolyte resistant material.

The individual electrolytic cell 11 further includes an end plate 81 and an end gasket 83 on each end as well as compressive means, for example, bolts 85 and nuts 87, such that the gaskets 71, end plate 81, end gaskets 83, bolts 85, and nuts 87 provide an electrolyte tight cell.

While the individual cells 11 may be spaced remotely from each other and connected by heavy copper cable or bus bars, in a particularly preferred exemplification the individual cells 11 are mounted on a common structural member, for example, rails, and joined by a short bus connector, i.e., anodic bus bar 91 through anodic connector 95 and a cathodic bus bar 93 and a cathodic connector 97 joining in bolt and nut means 99.

According to an alternative resimplification of this invention, the planar electrode elements may be utilized in a bipolar configuration, as shown in the exemplification of FIGS. 7–10. As there shown, an electrolytic cell series 201 includes a plurality of two cell bipolar electrolyzers 205 each having a pair of individual cells 211. The bipolar electrode units 219 of the individual electrolyzer 211 are parallel to each other and have an anode subunit 221 and a cathode subunit 241. Interposed between each pair of bipolar units 219 are monopolar units 221A–241A. The monopolar units 221A–241A are arrayed end-to-end, and electrically insulated from each other. The anodic monopolar units 221A are parallel to, face, and spaced from the cathodic subunit 241 of the bipolar unit 219, while the cathodic monopolar units 241A are parallel to, face, and are spaced from the anodic subunits 221 of the bipolar units 219. The cathodic monopolar units 241 are spaced from the anodic subunits 221 by an ion permeable separator sheet 271 and the anodic monopolar units 221A are spaced from the cathodic subunits 241 by an ion permeable separator sheet 271.

The bipolar unit 219 includes anodic subunit 221 and cathodic subunit 241. The anodic subunit 221 and cathodic subunit 241 are in end-to-end relationship with bipolar conduction means 261 between them.

The anodic subunit 221 includes a peripheral rectangular compartment frame 223 open on two major opposite surfaces to support the anodic electrode 237. The peripheral rectangular compartment frame 223 is fabricated of a pair of vertical channel frames 225 which may be "U" shaped. When "U" shaped, one or both of the vertical channel frames 225 may be concave with respect to the interior of the anodic subunit frame 223 and contain plate means 227 parallel to channel frame 225 whereby to define a downcomer 229. Plate means 227 are spaced from and parallel to the vertical channel frame 225 and the horizontal channel frames 225 whereby to define the downcomer 229. The peripheral rectangular compartment frame 223 further includes a pair of horizontal channel frames 225 which may also be "U" shaped and which may be either concave or convex with respect to the interior of the peripheral rectangular channel frame 223. The peripheral rectangular channel frame 223 is in the form of a picture frame. The channel frames 225 are fabricated of a valve metal, as defined hereinabove, or a laminate of a valve metal and a metal that is less resistant to acidified alkali metal chloride brines, with the valve metal facing the acidified brine.

The anodic electrode 237 is an electrolyte permeable planar element which may be mesh, perforated plate, perforated sheet, rods or the like, defining substantially a plane substantially parallel to the anodic subunit 221. Additionally, there is associated with the anodic subunit 221 brine feed means 231, chlorine recovery means 233 and depleted brine removal means 235, as well as bipolar connector 261.

The cathode subunit 241 of the bipolar element 219 includes a peripheral rectangular compartment frame 243 open on two major opposite surfaces to support the cathodic electrode 257. The cathodic subunit further includes a pair of vertical channel frames 245 which may be "U" shaped. When "U" shaped, one vertical channel frame 245 may be concave with respect to the interior of the peripheral rectangular compartment frame 243 and have plate means 247 therein, spaced from and parallel to the channel frames 245 whereby to define a downcomer 249. Either one or both of the vertical channel frames 245 may be concave with respect to the interior of the peripheral rectangular compartment frame 243. One of the vertical channel frames 245 carries a bipolar element 261.

The peripheral rectangular compartment frame 243 further includes a pair of horizontal channel frames 245 which may be "U" shaped, and both of which may be concave or convex or one may be concave and the other convex with respect to the interior of the peripheral rectangular compartment frame 243. The four channel frames 245 define a picture frame shaped peripheral rectangular compartment frame 243. The peripheral rectangular compartment frame 243 further includes a planar metal cathode on either opening, supported by the channel frame 243. The planar metal cathode 257 is an electrolyte permeable, catholyte liquor resistant element in the form of a perforated sheet, perforated plate, metal mesh, bars, rods or the like.

Associated with the cathodic subunit 241 of the bipolar element 219 are water feed line 251, hydrogen recovery line 253, and cell liquor recovery line 255, and bipolar element 261.

The bipolar element 261 depends from the facing vertical channel frames of the anodic subunit 221 and the cathodic subunit 241 of a bipolar element 219. According to one exemplification the bipolar element 261 that is, a bipolar conductor 261, may have a titanium or valve metal member 263 contacting the anodic subunit 221, an iron or steel member 265 contacting the cathodic subunit 241 and a high conductivity, hydrogen migration resistant material, for example, copper, being element 267 interposed between the titanium or valve metal element 263 and the iron element 265.

In a still further exemplification, where the anodic subunit 221 and cathodic subunit 241 are electrolyte tight, the bipolar element 261 may be a single element of a high conductivity metal, for example, a single copper element. The shape of the bipolar element 261 is not critical. The bipolar element 261 may be rectangular, or cylindrical.

The anodic monopolar units 221A and cathodic monopolar units 241A are interposed between the bipolar units 219.

The anodic monopolar unit 221A has a peripheral rectangular compartment frame 223, which is open on its two major opposite surfaces to support the anodic electrode 237. The peripheral rectangular compartment frame is provided by a pair of vertical channel frames 225 and a pair of horizontal channel frames 225. The vertical and horizontal channel frames may be "U" shaped. One or both of the vertical channel frames may be concave with respect to the interior of the channel frame 223 and have plate means 227 therein, defining a downcomer space 229 as described hereinabove. One or both of the horizontal channel frames may be U shaped, one or both may be concave or convex with respect to the interior of the peripheral rectangular compartment frame 223. The vertical channel frames 225 and hrizontal channel frames 225 define a picture frame.

The channel frames 225 of the peripheral rectangular compartment frame 223 are fabricated of a valve metal, as defined hereinabove.

The anodic electrode 237 of the anodic monopolar unit 221A is supported by the channel frames 223. It is an electrolyte permeable planar element laying in the plane of the channel frame 223 and may be in the form of sheets of mesh, perforated plate, perforated sheet, rods, bars or the like. The anode 237 is in the form of a valve metal substrate with a suitable electrode catalytic coating thereon.

The anodic monopolar unit 221A, including the peripheral rectangular compartment frame 223, further comprises brine feed means 231, chlorine recovery means 233, depleted brine removal means 235, and a bus bar 291.

The cathodic monopolar units 241A have a peripheral rectangular compartment frame 243 open on two major opposite surfaces to support cathodic elements 257. The peripheral rectangular compartment frame 243 is fabricated of a pair of vertical channel frames 245 and a pair of horizontal channel frames 245 defining a picture frame 243. The channel frames 245 may be "U" shaped, with one or both of the vertical channel frames being concave with respect to the interior of the channel frame of the rectangular compartment frame 243, and including plate means 247 arrayed therein and defining a downcomer 249. One of the vertical channel frames 245 is convex with respect to the interior of the peripheral rectangular compartment frame 243 and carries cathodic bus bar 293.

The planar metal cathodes 257 are supported by the peripheral rectangular compartment frame 243 and are fabricated of electrolyte permeable, catholyte resistant material, and may additionally have a hydrogen evolution catalyst disposed thereon.

The cathodic monopolar units 241A can be assembled as a single unit with an anodic monopolar unit 221A with which it is in end-to-end relationship separated therefrom by an insulator 269 therebetween. Alternatively, the cathodic monopolar 241A may be spaced from the anodic monopolar unit 221A with which it is an end-to-end relationship.

The cathodic monopolar unit includes water feed 251, hydrogen recovery 253, cell liquor recovery 255 and bus bar 293.

Interposed between of each pair of monopolar units 221A, 241A, and the adjacent, facing bipolar units 219 are gaskets 273. The gaskets serve to provide electrolyte tight integrity to the electrolyzer 205 as well as spacing the permionic membrane 271 from either the anodic surface 237 or the cathodic surface 257 or both, as described above with respect to the monopolar exemplification.

The electrolyzer 205 further includes compressive means, i.e., bolts 285 and nuts 287.

The electrical flow through the system is from anode bus bar 295 through the anodic monopolar unit 221A to the cathodic subunit 241 and thence through the bipolar element 261 to the anodic subunit 221 and through the electrolyte to the cathodic unit 241A and out of the cell through the cathodic bus bar 293.

The separator, shown as element 61 in the monopolar configuration and element 271, in the bipolar configuration separates the acidic anolyte liquor from the alkaline catholyte liquor. As herein contemplated, the separator 61, 271 is a single sheet-like monolithic element, characterized by the substantial absence of folds, joints, seals, welds or the like. The separator 61, 271 may be a resin reinforced asbestos sheet, a synthetic microporous diaphragm, or a permionic membrane. The flat sheet separator provides a minimum of lost area and particular ease of assembly.

The electrolytic cell herein contemplated is particularly useful for either a chlorine-caustic soda process or a chlorine-caustic potash process. As herein contemplated, brine is fed through the brine header 101, 201 to the individual brine inlets 31, 231 of the anodic elements. The brine may contain from 250 to 350 grams per liter of sodium chloride, or in the case of potassium chloride brine, about 325 to about 450 grams per liter of potassium chloride. An electrical potential is imposed across the cell, and depleted brine and chlorine are recovered from the individual anodic elements through the chlorine outlets and depleted brine outlets, 33 and 35, respectively, in the monopolar configuration 233 and 235 respectively in the bipolar configuration.

Cell liquor and hydrogen are recovered from the catholyte compartments of the cells. In a preferred exemplification where the separator 61, 271 is a permionic membrane, the catholyte liquor product is aqueous alkali metal hydroxide i.e., a 10 to 50 weight percent solution of sodium hydroxide or a 15 to 70 weight percent solution of potassium hydroxide, substantially salt free, and it is necessary to feed water to the catholyte elements.

While the invention herein contemplated has been described with respect to certain exemplifications and embodiments thereof, the invention is not to be so limited except as in the claims appended hereto.

I claim:

1. An electrolytic cell comprising a plurality of hollow anode electrode elements electrically in parallel with each other, and a plurality of hollow cathode electrode elements electrically in parallel with each other; each of said anode electrode elements interposed between a pair of cathode electrode elements and separated therefrom by a planar, ion permeable, separator sheet; each of said cathode electrode elements interposed between a pair of anode electrode elements and separated therefrom by a planar, ion permeable, separator sheet; wherein said anode electrode elements and cathode electrode elements are in compression whereby to provide an electrolyte tight electrolytic cell, and wherein said individual electrode units comprise:

(a) a peripheral, rectangular compartment frame open on two major opposite surfaces;

(b) said peripheral rectangular compartment frame comprising a pair of vertical "U" shaped channel frames, and a pair of horizontal "U" shaped channel frames; one of said vertical "U" shaped channel frames, and both of said horizontal "U" shaped channel frames being concave with respect to the interior of the anode unit; and the other of said "U" shaped vertical channel frames being convex with respect to the interior of the anode units;

(c) plate means within said concave vertical "U" shaped channel frame whereby to form an internal downcomer;

(d) bus bar means extending outwardly from said convex vertical channel frame;

(e) a planar metal electrode on each of said open major surfaces; and (f) electrolyte feed means, gas recovery means, and liquid recovery means passing through said compartment frame.

2. The electrolytic cell of claim 1 wherein each of said ion permeable separators comprise a planar sheet between an anode unit and an adjacent cathode unit.

3. The electrolytic cell of claim 2 wherein said ion permeable separators are chosen from the group consisting of permionic membranes, microporous synthetic diaphragm, and resin reinforced asbestos diaphragms.

4. The electrolytic cell of claim 1 wherein said electrolytic cell comprises current conduction means between the anode units thereof and the cathode units of the next adjacent electrolytic cell; said current conduction means comprising resilient bus bar means extending from the anode units thereof, resilient bus bar means extending from the cathode units of the said next adjacent cell, and removable bolt means joining said bus bars.

5. A bipolar electrolyzer comprising:

(a) a plurality of bipolar electrode units parallel to each other, each bipolar having a hollow anode subunit and a hollow cathode subunit, and being spaced from the bipolar units adjacent thereto by a pair of monopolar electrode units;

(b) said monopolar electrode units being anode units and cathode units electrically insulated from and arranged end to end to each other;

(c) said anode monopolar units being parallel to, and facing the cathode subunits of the bipolar units adjacent thereto, and being separated therefrom by a planar, ion permeable separator sheet; and (d) said cathode monopolar units being parallel to, and facing the anode subunits of the bipolar units adjacent thereto, and being separated therefrom by a planar, ion permeable separator sheet.

6. The bipolar electrolyzer of claim 5 wherein said bipolar unit comprises an anodic subunit, a cathodic subunit end to end to said anodic subunit, and bipolar electrical conduction means therebetween.

7. The bipolar electrolyzer of claim 5 wherein said anode subunit comprises:

(a) A peripheral rectangular compartment frame open on two major opposite surfaces;

(b) a planar metal anode on each of said open major surfaces; and (c) brine feed means, gas recovery means, liquid recovery means, and bipolar current conduction means, passing through said compartment frame.

8. The bipolar electrolyzer of claim 7 wherein said peripheral rectangular compartment frame comprises a pair of vertical channel frames and a pair of horizontal channel frames joined together to form a picture frame.

9. The bipolar electrolyzer of claim 8 wherein said channel frames are fabricated of a valve metal.

10. The bipolar electrolyzer of claim 7 wherein each of said planar metal anodes comprises an electrolyte permeable valve metal substrate having an electrocatalytic surface thereon.

11. The bipolar electrolyzer of claim 7 wherein said anode subunit comprises:

(a) a peripheral, rectangular compartment frame open on two major opposite surfaces;

(b) said peripheral rectangular compartment frame comprising a pair of vertical "U" shaped channel frames, and a pair of horizontal "U" shaped channel frames; one of said vertical "U" shaped channel frames, and both of said horizontal "U" shaped channel frames being concave with respect to the interior of the anode unit; and the other of said "U" shaped vertical channel frames being convex with respect to the interior of the anode units; and (c) plate means within said concave vertical "U" shaped channel frame whereby to form a downcomer.

12. The bipolar electrolyzer of claim 6 wherein said cathode subunit comprises:

(a) a peripheral rectangular compartment frame open on two major opposite surfaces;

(b) a planar metal cathode on each of said open major surfaces; and (c) water feed means, gas recovery means, liquid recovery means, and bipolar current conduction means passing through said compartment frame.

13. The bipolar electrolyzer of claim 12 wherein said peripheral rectangular compartment frame comprises a pair of vertical channel frames, and a pair of horizontal channel frames joined together to form a picture frame.

14. The bipolar electrolyzer of claim 13 wherein said channel frames are fabricated of an alkali metal hydroxide resistant metal.

15. The bipolar electrolyzer of claim 13 wherein each of said planar metal cathodes comprises an electrolyte permeable, aqueous alkali metal hydroxide resistant, metal sheet.

16. The bipolar electrolyzer of claim 13 wherein said cathode subunit comprises:

(a) a peripheral, rectangular compartment frame open on two major opposite surfaces;

(b) said peripheral rectangular compartment frame comprising a pair of vertical "U" shaped channel frames, and a pair of horizontal "U" shaped channel frames; one of said vertical "U" shaped channel frames, and both of said respect to the interior of the cathode unit;

(c) plate means within said concave vertical "U" shaped channel frame whereby to form a downcomer; and (d) bus bar means extending outwardly from said convex channel frame.

17. The bipolar electrolyzer of claim 5 wherein said anode monopolar units comprise:

(a) a peripheral rectangular compartment frame open on two major opposite surfaces;

(b) a planar metal anode on each of said open major surfaces; and (c) brine feed means, gas recovery means, liquid recovery means, and current conduction means passing through said compartment frame.

18. The bipolar electrolyzer of claim 17 wherein said peripheral rectangular compartment frame comprises a pair of vertical channel frames and a pair of horizontal channel frames joined together to form a picture frame.

19. The bipolar electrolyzer of claim 18 wherein said channel frames are fabricated of a valve metal.

20. The bipolar electrolyzer of claim 17 wherein each of said planar metal anodes comprises an electrolyte permeable valve metal substrate having an electrocatalytic surface thereon.

21. The bipolar electrolyzer of claim 17 wherein said anode monopolar unit comprises:

(a) a peripheral, rectangular compartment frame open on two major opposite surfaces;

(b) said peripheral rectangular compartment frame comprising a pair of vertical "U" shaped channel frames, and a pair of horizontal "U" shaped channel frames; one of said vertical "U" shaped channel frames, and both of said horizontal "U" shaped channel frames being concave with respect to the interior of the anode unit; and the other of said "U" shaped vertical channel frames being convex with respect to the interior of the anode units;

(c) plate means within said concave vertical "U" shaped channel frame whereby to form a downcomer; and (d) bus bar means extending outwardly from said convex vertical channel frame.

22. The bipolar electrolyzer of claim 5 wherein said cathode monopolar units comprise:

(a) a peripheral rectangular compartment frame open on two major opposite surfaces;

(b) a planar metal cathode on each of said open major surfaces; and (c) water feed means, gas recovery means, liquid recovery means, and current conduction means passing through said compartment frame.

23. The bipolar electrolyzer of claim 22 wherein said peripheral rectangular compartment frame comprises a pair of vertical channel frames, and a pair of horizontal channel frames joined together to form a picture frame.

24. The bipolar electrolyzer of claim 23 wherein said channel frames are fabricated of an alkali metal hydroxide resistant metal.

25. The bipolar electrolyzer of claim 23 wherein each of said planar metal cathodes comprises an electrolyte permeable, aqueous alkali metal hydroxide resistant, metal sheet.

26. The bipolar electrolyzer of claim 23 wherein said cathode unit comprises:

(a) a peripheral, rectangular compartment frame open on two major opposite surfaces;

(b) said peripheral rectangular compartment frame comprising a pair of vertical "U" shaped channel frames, and a pair of horizontal "U" shaped channel frames; one of said vertical "U" shaped channel frames, and both of said horizontal "U" shaped channel frames being concave with respect to the interior of the cathode unit; and the other of said "U" shaped vertical channel frames being convex with respect to the interior of the cathode unit;

(c) plate means within said concave vertical "U" shaped channel frame whereby to form a downcomer; and (d) bus bar means extending outwardly from said convex channel frame.

27. The bipolar electrolyzer of claim 5 wherein each of said ion permeable separators comprise a planar sheet between an anode unit and an adjacent cathode unit.

28. The bipolar electrolyzer of claim 27 wherein said ion permeable separators are chosen from the group consisting of permionic membranes, microporous synthetic diaphragm, and resin reinforced asbestos diaphragms.

29. The bipolar electrolyzer of claim 5 wherein said bipolar electrolyzer comprises compressive means for maintaining said bipolar electrolyzer electrolyte tight.

30. The bipolar electrolyzer of claim 5 wherein said bipolar electrolyzer comprises current conduction means between the anode monopolar units thereof and the cathode monopolar units of the next adjacent bipolar electrolyzer; said current conduction means comprising resilient bus bar means extending from the anode monopolar units thereof, resilient bus bar means extending from the cathode monopolar units of the said next adjacent electrolyzer and removable bolt means joining said bus bar.

* * * * *